US005147222A

United States Patent [19]

Hotea et al.

[11] Patent Number: 5,147,222

[45] Date of Patent: Sep. 15, 1992

[54] SEALED ELECTRICAL CONNECTOR

[75] Inventors: Gheorghe Hotea, Griesheim; Jurgen Hass, Erzhausen, both of Fed. Rep. of Germany

[73] Assignee: AMP Incorporated, Harrisburg, Pa.

[21] Appl. No.: 816,794

[22] Filed: Jan. 3, 1992

Related U.S. Application Data

[63] Continuation of Ser. No. 602,432, Oct. 23, 1990, abandoned.

[51] Int. Cl.[5] ..... H01R 13/52

[52] U.S. Cl. ..... 439/589; 439/695; 439/752

[58] Field of Search ..... 439/274, 275, 278, 279, 439/587, 589, 686, 690, 695, 701, 752

[56] References Cited

U.S. PATENT DOCUMENTS

| | | | |
|---|---|---|---|
| 4,214,802 | 7/1980 | Otani et al. | 439/275 |
| 4,497,531 | 2/1985 | Baker . | |
| 4,621,883 | 11/1986 | Noguchi | 439/278 |
| 4,797,116 | 1/1989 | Isohata et al. | 439/274 |
| 4,904,198 | 2/1990 | Begitschke et al. | 439/278 |
| 4,963,106 | 10/1990 | Wendling et al. | 439/595 |
| 5,076,806 | 12/1991 | Hotea et al. | 439/278 |

FOREIGN PATENT DOCUMENTS

| | | | |
|---|---|---|---|
| 3021845 | 12/1981 | Fed. Rep. of Germany | 439/275 |

*Primary Examiner*—Gary F. Paumen

*Attorney, Agent, or Firm*—Bruce J. Wolstoncroft; Eric J. Groen

[57] ABSTRACT

An electrical connector includes an outer shell (400) which is profiled to receive a pin housing (450) therein. The pin housing (450) has mounted therein a plurality of pins (622). The interior of the housing shell (400) is sealed by placing a grommet (624) over the end of a wire (626) and placing the terminal (622), the grommet (624) and wire (626) into the rear of the connector shell (400). To prevent the ingress of water into the shell (400), the grommet (624) includes at its exterior end, an elongate collar (**624*b***) which, if the wire is pulled, will compress. This prevents the exterior ribs from pulling away from the aperture allowing the ingress of water.

4 Claims, 8 Drawing Sheets

SEALED ELECTRICAL CONNECTOR

This application is a continuation of application Ser. No. 07/602,432 filed Oct. 23, 1990, now abandoned.

BACKGROUND OF THE INVENTION

1. Field of the Invention

The subject invention relates to an improved electrical connector housing and more particularly to an terminals within their housing.

2. Description of the Prior Art

It is quite common in the electrical connector industry today to require that electrical terminals be sealed from the exterior environment, such as, from moisture or other contaminants. In some of the prior art grommets, the electrical connectors contain sealing grommets which are slid over the ends of insulated conductors, and are then slid forwardly into an aperture at the rear of the connector housing. In these prior connectors, the seals contain peripheral ribs around the sealing grommet, which when inserted into the apertures, are compressed which seals the aperture. One of the disadvantages of these connectors is that, if the wire is pulled at an angle relative to its axial dimension, the force against the sealing grommet will compress the sealing grommet, and at the position diametrically opposed from the wire, the sealing grommet will actually pull away from the housing aperture, thereby allowing moisture to enter. After numerous such cycles, the water is eventually "pumped" into the connector housing into the terminal chambers where the moisture can corrode the terminals.

The object of the invention then is to provide for an electrical connector having an improved sealing to prevent such ingress of moisture.

SUMMARY OF THE INVENTION

The above mentioned object was accomplished by providing for a connector assembly characterized in that the housing includes at least one terminal receiving passageway, where the passageway includes a bore at the end thereof, profiled to receive a wire sealing grommet, the grommet profiled to be compressibly placed into the bore. The grommet has a plurality of peripheral spaced apart ribs and a through hole which allows the grommet to be slideably placed over a wire to be sealed. The grommet contains at its outward end, an elongate collar, which is adjacent to the rear face of the connector housing. Thus, if the wire is pulled at an angle relative to the axial length, the collar, not the ribs will be compressed, which prevents water from entering past the first rib.

DETAILED DESCRIPTION OF THE PREFERRED EMBODIMENT

Figure 1:
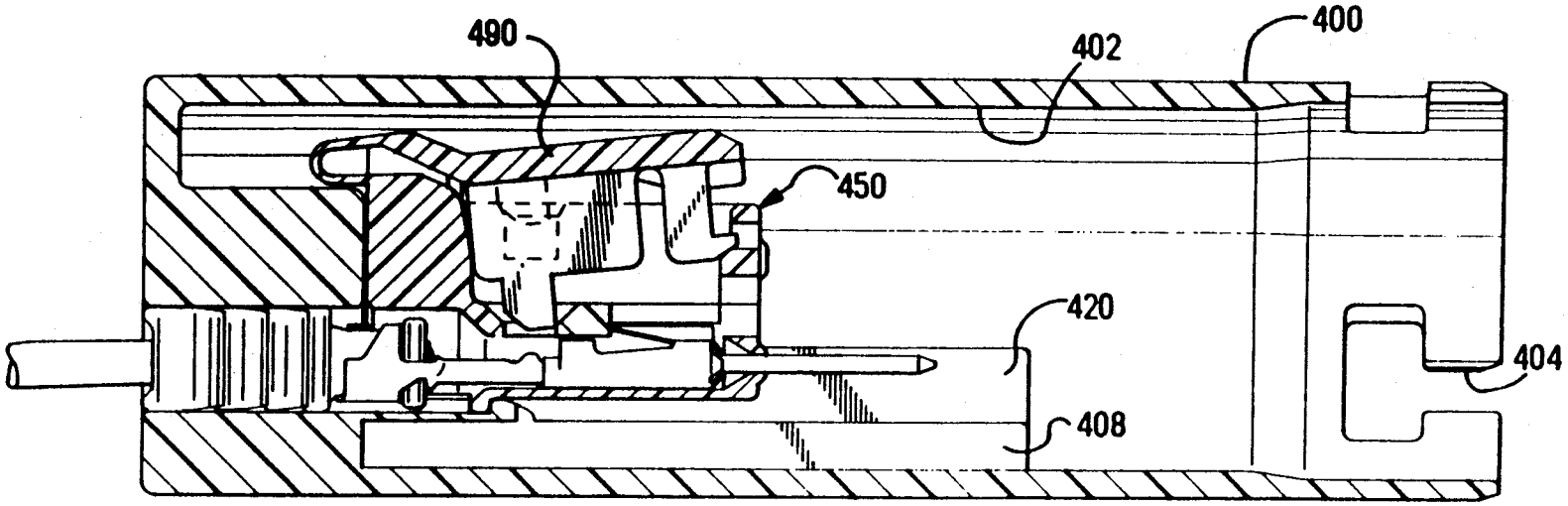
FIG. 1 is a cross-sectional view through lines 1—1 of the outer shell as shown in FIG. 9, including the assembly of the pin housing insert as shown in FIGS. 4 and 5.
Figure 3:
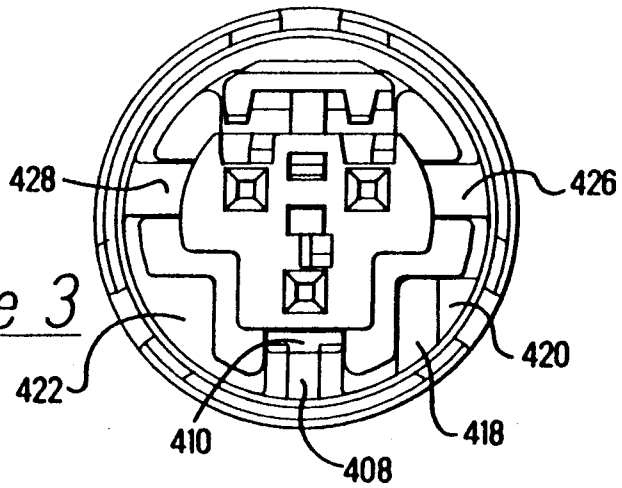
FIG. 3 is a front plan view of the shell of FIG. 1, less the terminals.
Figure 2:
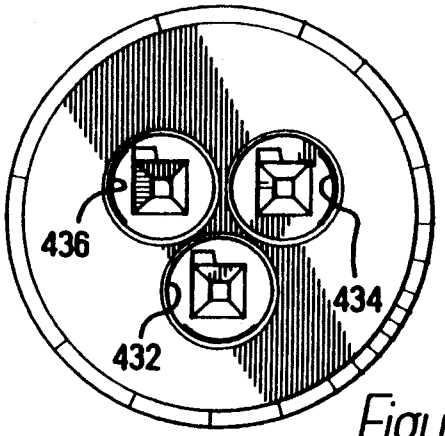
FIG. 2 is a rear plan view of the shell as shown in FIG. 1, less the terminals.
Figure 9:
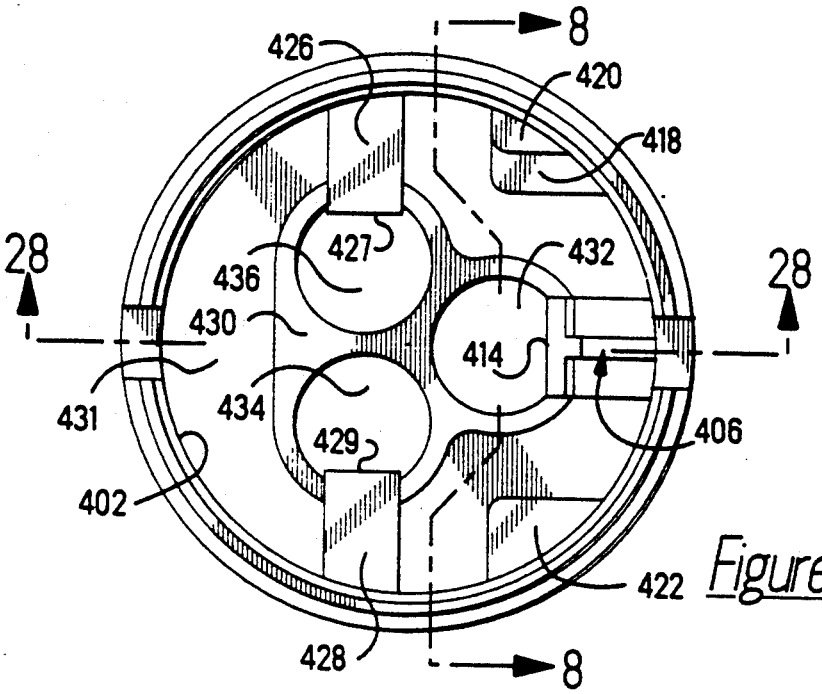
FIG. 9 is an end view of the shell member shown in FIG. 8 looking in from the front.
Figure 8:
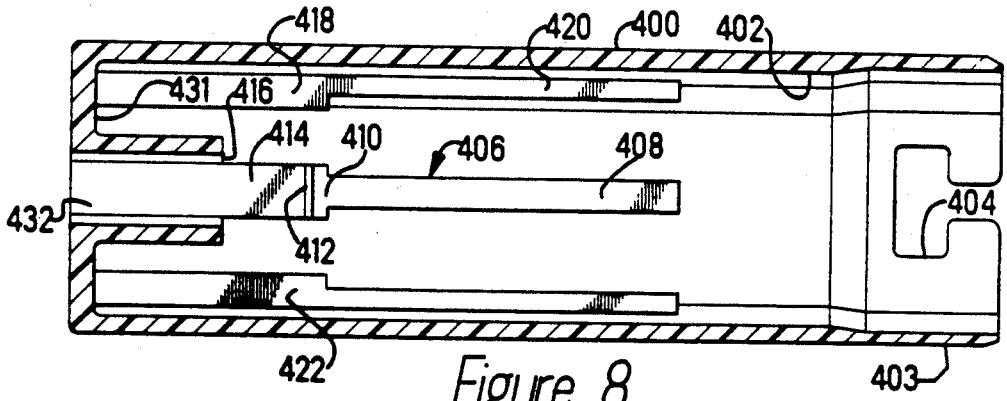
FIG. 8 is a cross-sectional view of the outer shell member through lines 8—8 of FIG. 9.
Figure 10:
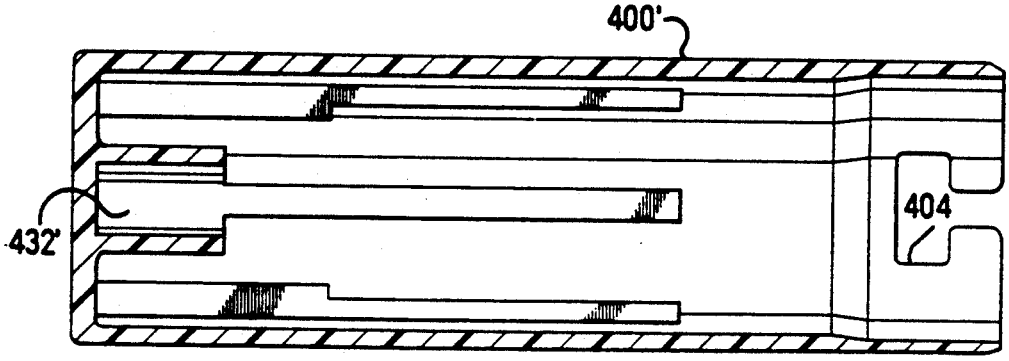
FIG. 10 shows an alternate embodiment of a shell member for a two position connector.

As shown in FIG. 1, the connector is shown as including a shell member 400 where a pin insert 450 is latchably retained therein. With reference now to FIGS. 8 through 10, the shell member will be described in greater detail. As shown in FIG. 8 and 9, the shell 400 generally includes an inner bore surface 402 and a front mating end 403 including T-slots 404 similar to those in the first embodiment. The shell member also includes keying via alignment wedges 418 and 422 which extend forwardly from the rear of the shell member 400. In order to key the pin inserts with the various shells, a portion of keying wedge 420 extends from the portion 418 and has a narrower structure to allow for keying of the pin insert. It should be noted that with these keying wedges, several keyed arrangements are possible.

As shown in FIG. 9, a pillar portion 430 extends upwardly from the rear face 431 of the shell member 400 and includes a lower bore 432 and two upper bores 434 and 436. The pillar portion 430 extends upwardly from the rear face 431 of the shell member to an end surface 416 as shown in FIG. 8. From the end surface 416 of the pillar portion 430 three alignment members 406, 426 and 428 extend forwardly towards the front end of the shell member 400. Each of the alignment members 406, 426 and 428 have surfaces 414, 427 and 429 respectively, which are continuous with the inner surface of the bores 432, 436 and 434 respectively. The alignment member 406 is more complex than the other two alignment members 426 and 428, as the alignment member 406 also includes a latching feature comprising a ramped surface 410 as shown in FIG. 8 and a rearwardly facing shoulder 412. An alignment bar 408 extends forwardly from the rear section of the alignment member and is positioned proximate to the front end 403 of the shell member for positioning of the pin insert during installation.

FIG. 10 shows an alternate embodiment of the shell 400' for a two position connector which would use two side by side bores similar to 434 and 436 (FIG. 9) where a third lower bore such as 432' is simply not molded into place.

Figure 4:
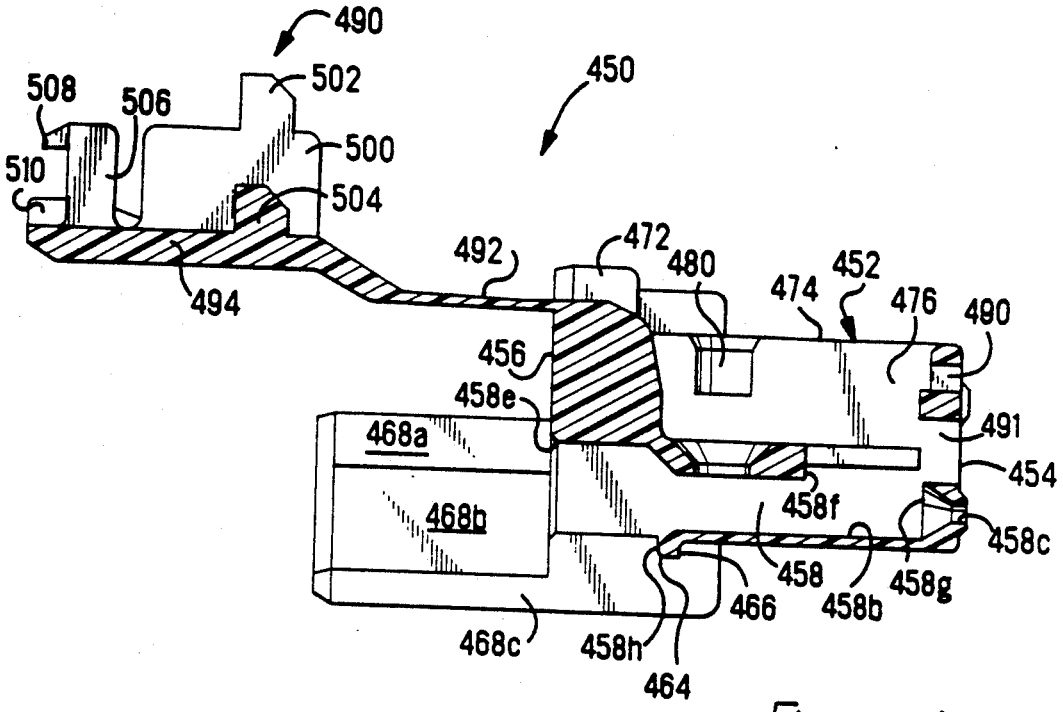
FIG. 4 is a cross-sectional view of the pin housing insert through lines 5—5 of FIG. 7.
Figure 5:
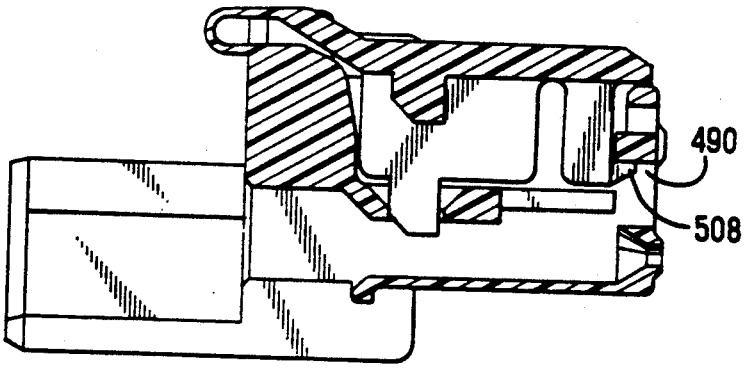
FIG. 5 is a cross-sectional view similar to that of FIG. 4 showing the secondary retention mechanism in a latched position.
Figure 7:
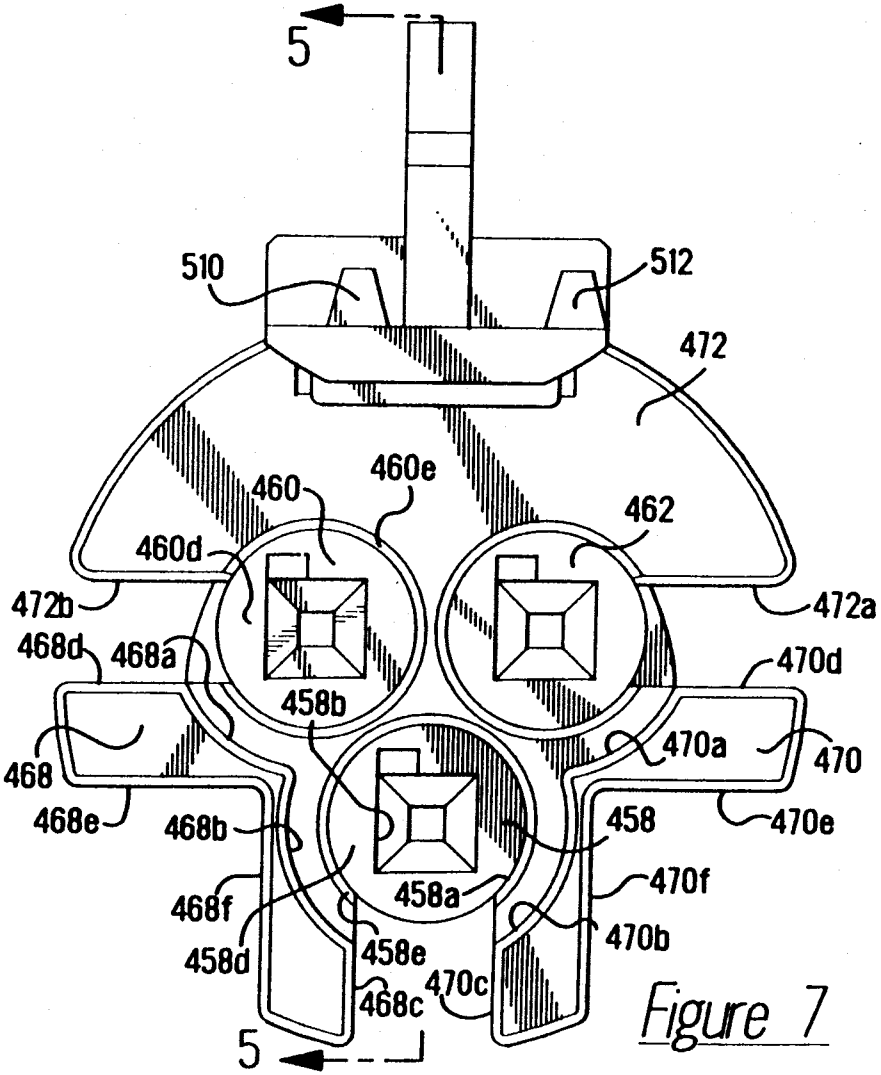
FIG. 7 is a rear plan view of the pin housing insert.
Figure 6:
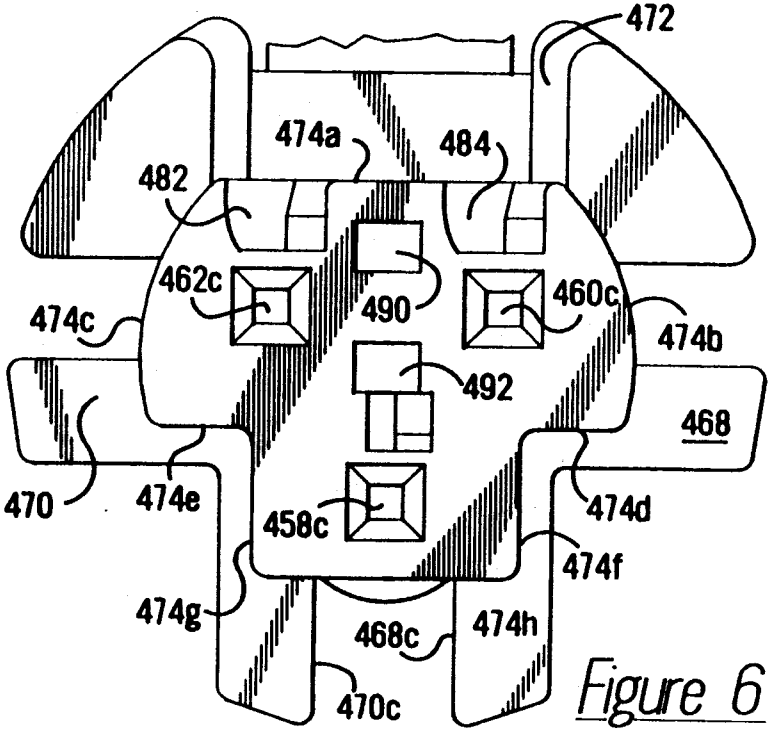
FIG. 6 is a front plan view of the pin housing insert.

With respect now to FIGS. 4–7, the pin insert will be described in greater detail. The pin insert 450 generally comprises a body portion 452 and a flexible secondary lock portion 490. The housing portion 452 comprises a front mating face 454 and a rear face 456, with a plurality of terminal receiving passageways 458, 460 and 462 (FIG. 7) extending therebetween. With reference to FIG. 4, the terminal passageway 458 will be described in detail. The internal passageway 458 comprises a square aperture portion 458*b* which is in communication with a cylindrical bore portion 458*a* through a frusto-conical surface 458*d*. At the front face 454 of the housing portion, the aperture portion 458*c* is in communication with the inner terminal passageway 458*b*. As shown in FIG. 4 and 34, alignment members 468 and 470 extend from the rear face 456 of the housing portion 452. The alignment members 468 includes an upper semi-cylindrical portion 468*a*, a lower semicylindrical portion 468*b*, a lower vertical planar surface 468*c*, and an upper horizontal planar surface 468*d*. The alignment member 470 is a virtue mirror image of the alignment member 468 and therefore will not be described in detail. It should be noted here that the profiles of the semi-cylindrical surfaces 468*a*, 468*b*; 470*a*, 470*b* are profiled to overlap the pillar portion 430 (FIG. 9) of the shell member 400. It should also be noticed that the outer surtaces 470*e* and 470*f* are profiled to be received over the alignment wedge 422 whereas the outer surfaces 468*e* and 468*f* are profiled to be received over the alignment lugs 418 and 420. As shown in FIGS. 4, 6 and 7, the inner terminal passageway includes an axial slot defined by surfaces 468C and 470C.

In a similar manner to the housing portions of the first embodiment, the pin housing 450 includes in the upper surface 474, a cross-shaped slot comprising an axial slot 476 and a transverse slot 480, as shown in FIG. 4. A vertical passageway 478 is continuous with the axial slot 476 and also communicates with the lower passageway 458*b*. In a similar manner, the transverse slot 480 communicates with the upper passageways 460 and 462. As shown in FIGS. 4 and 6, the front face 454 of the housing portion 452 further includes two apertures 490 and 491 which provide for latching purposes and will be described in greater detail herein.

The pin housing member 450 also includes a hinged rotatable secondary lock portion 490 which is integrally molded to the housing portion 452 via a web 492 of plastic material. The secondary lock portion 490 comprises a plate member 494 having an axial bar 500 extending upwardly with a vertical peg portion 502 and a transverse bar portion 504, all integral with the plate portion 494. A vertical upstanding latching leg 506 is also included having a latching peg 508. As shown in FIGS. 4 and 7 two alignment pegs 510 and 512 also upstand from the upper surface of the plate portion 494.

Figure 14:
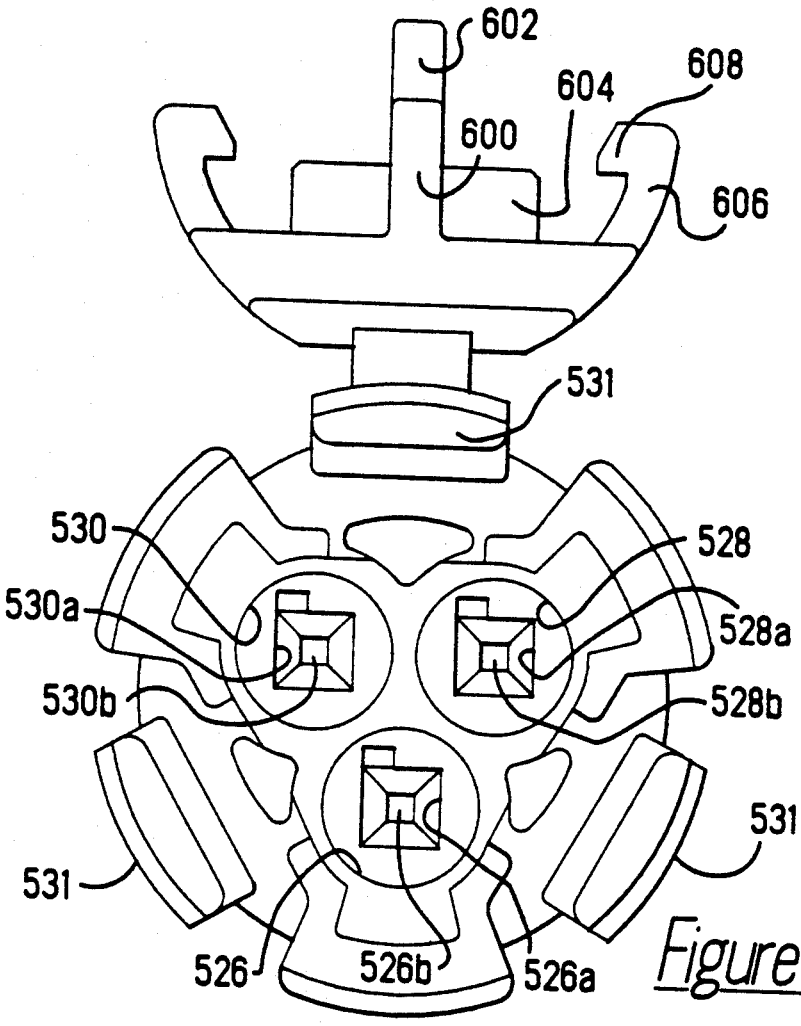
FIG. 14 is a rear plan view of the socket housing.
Figure 15:
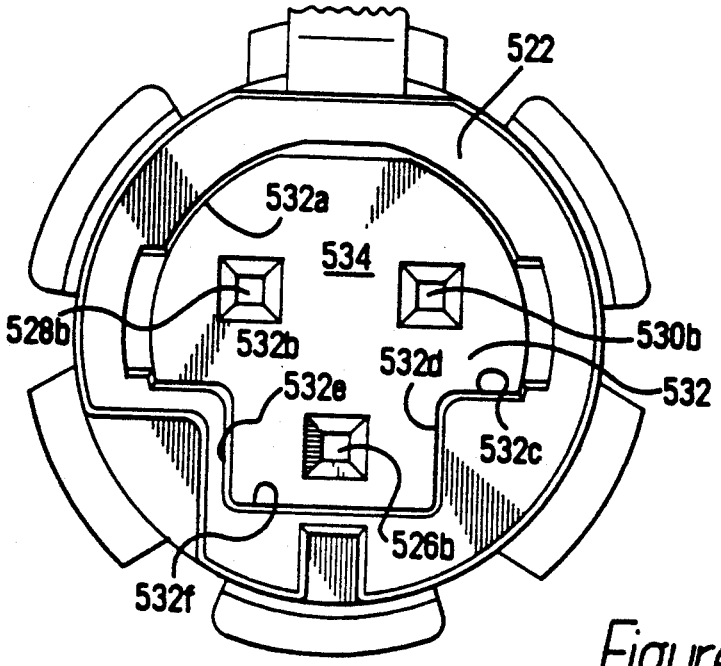
FIG. 15 is a front plan view showing the socket housing.

With reference now to FIGS. 11–15, the socket housing of the second embodiment will be described in greater detail. The socket housing 520 generally includes a mating end 522 and a cable receiving end 524. The socket housing 520 includes a plurality of socket receiving passageways 526, 528 and 530 which extend from a rear face 525 forwardly to an inner surface 534. Each of the terminal receiving passageways such as 526 generally includes a pin receiving aperture 526*b*, a square shaped aperture 526*a* and a sealing bore surface 526*c*. With reference to FIG. 15, the mating end 522 includes an aperture 532 defined by the semi-circular inner surface 532*a*, the horizontal surfaces 532*b*, 532*c* and 532*f*; and vertical surfaces 532*d* and 532*e*. Each of these surfaces extends from the front end 522 to a rear face 534. It should be noted that these inner surfaces 532*a*–532*f*, are cooperatively profiled to receive the mating end of the pin socket 450 as shown in FIG. 6.

Figure 11:
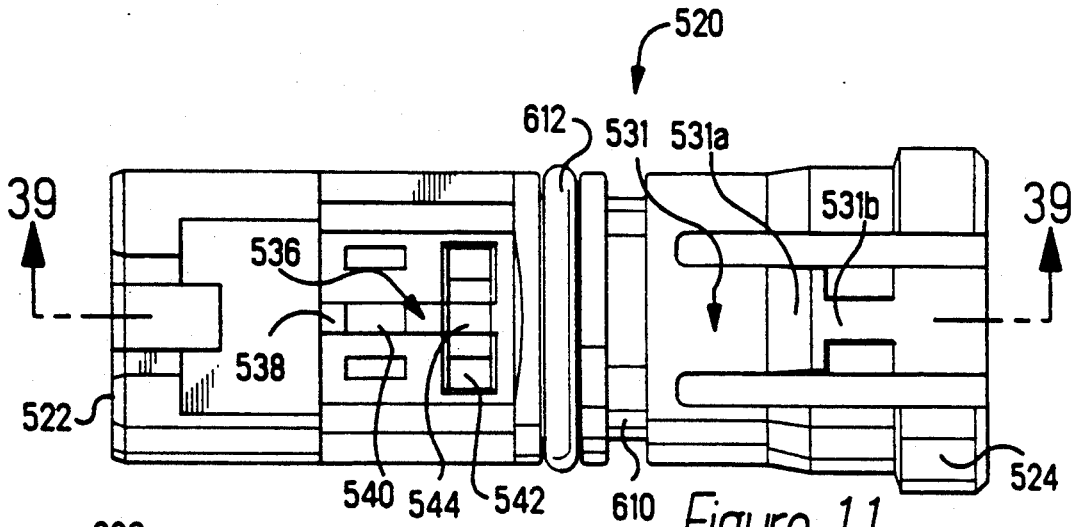
FIG. 11 is a top plan view showing the socket housing.
Figure 12:
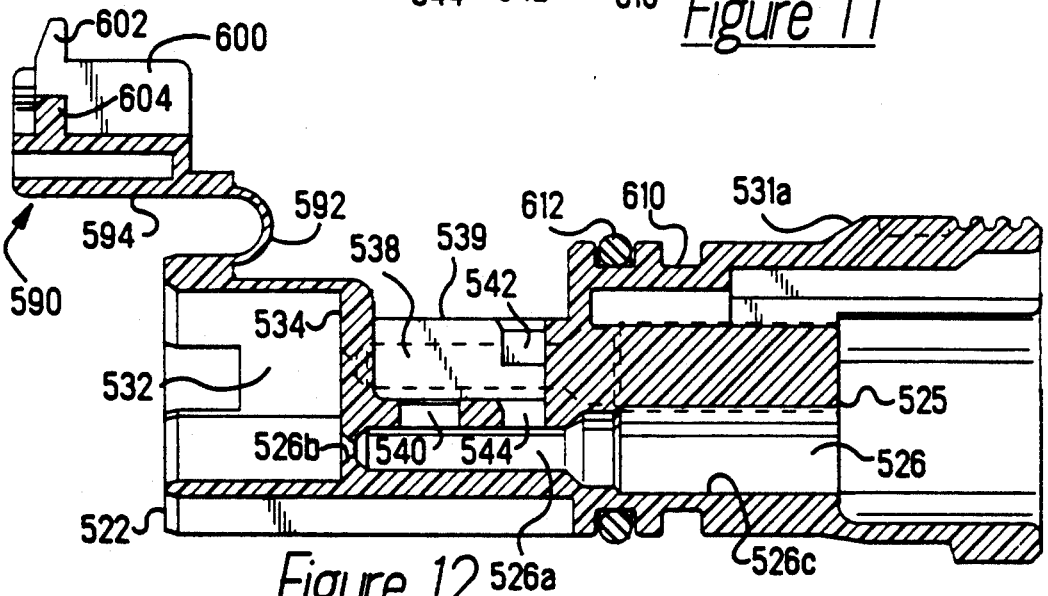
FIG. 12 is a cross-sectional view through lines 12—12 of FIG. 11.
Figure 13:
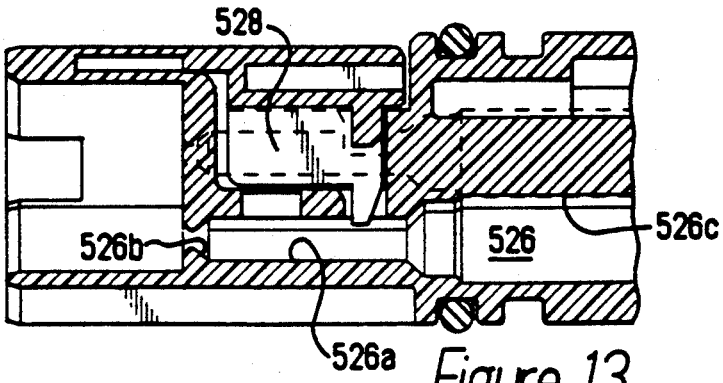
FIG. 13 is a partial cross-sectional view similar to that of FIG. 12 showing the secondary retention mechanism in a latched condition.

As shown in FIG. 11, a T-shaped slot 536 is in laterally centered relative to the lower terminal receiving passageway 526 and generally includes an axial slot 538 and a transverse slot 542. As best shown in FIG. 12, a vertical slot 544 extends downwardly from the axial slot 538 and communicates with the forward bore 526 of the terminal passageway. The transverse slot 542 communicates with the passageways 528 and 530. A hinged secondary lock 590 is integrally molded to the socket housing via a integral web 592. The secondary lock 590 includes a circular plate portion 594 which is profiled to overlay the semi-circular opening 539 at the top of the socket housing. The secondary lock 590 also includes an axial bar 600 from which extends a vertical peg section 602. A transverse bar 604 also extends from the circular plate portion 594.

When in the locked position, the axial plate portion 600 is positioned in the axial slot 538, the transverse bar 604 is positioned in the transverse slot 542 with a section of the vertical peg extending into the terminal receiving cavities and the vertical peg 602 is positioned in the vertical slot 544 with a portion of the vertical peg extending into the terminal passageway 526. It should be noted in FIG. 13, that the terminal receiving passageway 528 is shown in phantom with the transverse bar section 604 extending into the terminal passageway 528.

As shown in FIG. 14, three latch arms 531 extend from the rear of the socket housing 520 and as shown in FIG. 11 include ramped surfaces 531*a* and a latching arm 531*b*.

Figure 16:
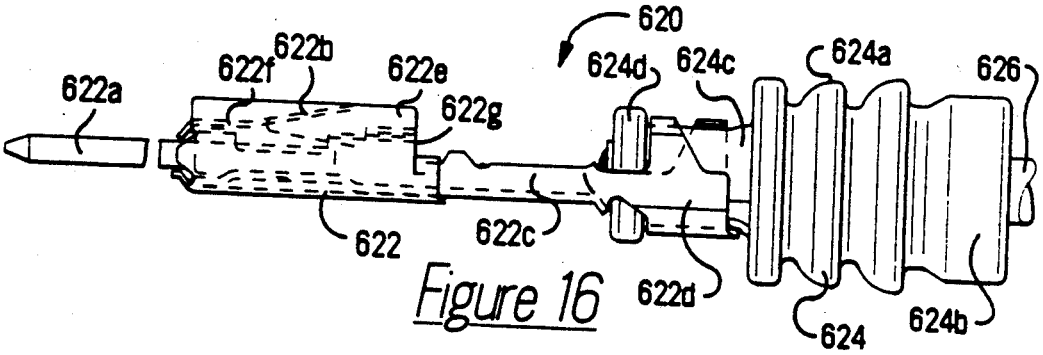
FIG. 16 is a side plan view showing the pin member shown in an assembled manner.
Figure 17:
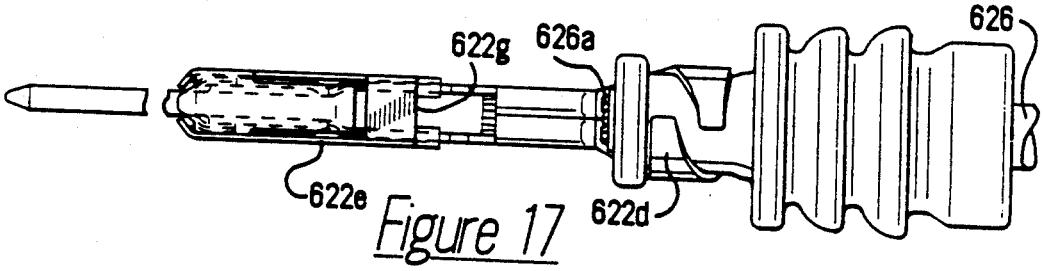
FIG. 17 is a top plan view similar to that of FIG. 16.

With reference now to FIG. 16 and 17, the terminal used in the pin housing is shown as a completed cable assembly 620 comprising a pin terminal 622, a grommet seal section 624 and a cable 626. The pin terminal generally comprises a forward pin section 622*a*, a lance section 622*b* which is stamped from and extends above a generally box shaped section 622*f*. A vertical plate portion 622*e* upstands above the top surface of the box shaped section 622*f* as shown in FIG. 16. The pin terminal 622 also comprises a crimp section 622*c* which terminates the individual conductor 626*a* of the electrical cable 626 thereto. The pin terminal 622 also includes a strain relief section 622*d* which is crimped around a reduced diameter section 624*c* of the grommet 624 and behind a forward portion 624*d* of the grommet 624.

Figure 18:
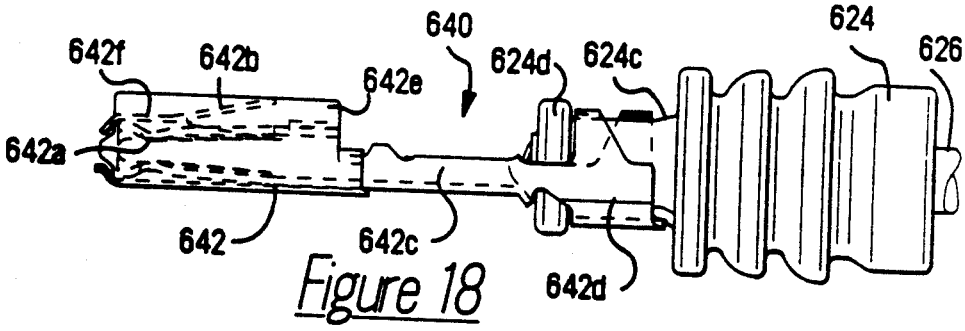
FIG. 18 is a side plan view showing the socket member shown in an assembled manner.
Figure 19:
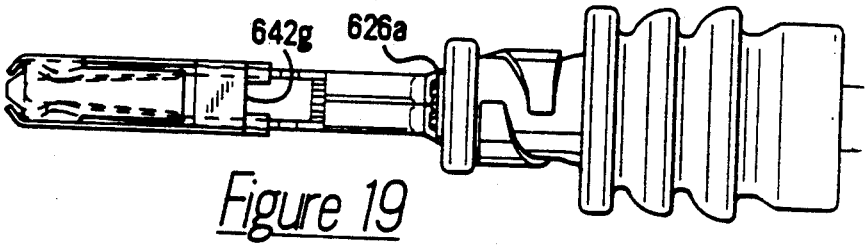
FIG. 19 is a top plan view similar to that of FIG. 18.

With reference now to FIGS. 18 and 19, the socket cable assemblies 640 are shown as generally including a socket terminal 642, a wire sealing grommet 624 and an electrical conductor 626. It should be noted that the grommets and the socket assembly 640 are identical to the grommets in the pin terminal assemblies 620. The socket terminals 642 generally comprise opposed contacts 642*a*, a retention lance 642*b*, and a crimp section 642*c* which is electrically connected to the conductor 626*a* of the cable 626. The strain relief section 642*d* of the terminal 642 is wrapped around the reduced diameter section 624*c* of the grommet 624 directly behind the forward rib 624*d* of the grommet 624. As in the pin terminal 622, the socket terminal 642 also comprises a vertical plate section 642*e* which upstands vertically higher than the box shaped section 642*f*.

To assemble the second embodiment of the invention, the pin housing 450 is assembled by starting with the housing 450 as shown in FIG. 4 with the secondary lock member 490 in an unlatched position. The lock member 490 is now rotated such that the vertical plate 500 is inserted into the axial slot 476 and the latch arm 506 is brought into registry with the first aperture 490 such that the locking peg 508 on the latch are 506 is situated in the first or upper aperture 490. It should be noted that FIG. 1 shows the pin housing 450 in this position and, when in this position, the vertical peg 502 and the transverse bar section 504 do not extend into the terminal receiving passageways, but rather are slightly above the passageway.

The pin housing 450 may now be placed in the front of the shell member 400 such that the space between the walls 470*d* and 472*a* (FIG. 7) are aligned with the alignment member 428, and that the space between the two surfaces 472*b* and 468*d* are aligned with the horizontal alignment member 426. This will also align the alignment member 406 with the space between the two surfaces 468*c* and 470*c*. It should be noted that when in place, the surfaces 427, 429 and 414 (FIG. 9) actually complete the pin terminal passageways 460, 462 and 458, (FIG. 7) respectively. Said differently, the terminal receiving passageways, for example, terminal passageway 458, is partially cylindrical from the position 458*h* to the rear wall 456 (FIG. 4). The surfaces 468*c* and 470*c* (FIG. 7) form an open seam along the entire length of the cylindrical passageway 458*a*. When the pin housing 450 is inserted into the shell member 400, the surface 414 (FIG. 8) is received between the two surfaces 468*c* and 470 thereby completing the terminal passageway 458. Conveniently, the alignment member 406 (FIG. 8) also includes the latching shoulder 412 which will latch behind the surface 466 (FIG. 4) to lock the pin housing in place as shown in FIG. 1.

Since the latching shoulder 412 is an extension of the bore 432, the outer periphery of the shell member 400 is uninhibited with further apertures defined by with drawing mold dies to provide latching surfaces. Said differently, when a latching surface has to be formed on an interior of a housing, and when the latching surface is rearwardly facing, a mold die must be pulled from the rear to form that rearwardly facing latch surface. However, in this case, the bore has to be formed anyway, so that the latching structure which retains the shell and the pin housing together is simply an extension of the bore which is already to be molded. This is quite advantageous when the connector assembly is to be sealed, because no other apertures need to be filled or sealed in any other manner.

With the secondary lock member 490, in the position shown in FIG. 1, the pin terminal assemblies 620 can be inserted into the three rear apertures 432, 434 and 436. Continued insertion of the pin section 622*a* through the pin through hole 458*c* will position the retention lance 622*b* (FIG. 16) against the latching shoulder 458*f* (FIG. 4) to form the primary retention feature for the pin terminals. With all three pin terminals in place as described above, a narrow tool such as a thin bladed tool can be inserted into the bore 402 of the shell member to more the secondary lock into its locked position, that position being shown in FIG. 5 where the locking peg 508 now resides in the second or lower aperture for 491.

It should be noted that when the secondary lock member is in the position shown in FIG. 1, the connector halves could not be made. When in the locked position as shown in FIG. 5, the transverse bar 504 will reside in the transverse slot 480 and the vertical peg 502 will extend into the vertical aperture 478 such that both the transverse bar 504 and the vertical peg 502 extends into the envelope of the terminal passageways and will be locked behind the sheared surface 622*g* (FIG. 17) of the pin terminals 622.

In a similar manner, the socket terminals 642 are inserted into their respective passageways 526, 528 and 530 in the socket housing 520 to a position where the end retention lances 642*b* is located within the aperture 540 (FIG. 12). The secondary retention member 590 can now be brought into latched position where the axial bar 600 will reside in the axial slot 638 such that the vertical peg 602 and the transverse bar extend into the respective passageways 544 and 542 respectively when in this position the vertical peg 602 will reside in the terminal receiving passageway 526*a* and the transverse bar 604 will extend into the terminal receiving passageways 528 and 530 and in abuting relation with the sheared edge 642*g* (FIG. 19) of the socket terminal 642.

As assembled, the socket housing assembly is insertable into the shell so that the pins and socket members are matable. In the fully latched position, the latching members 531*b* (FIG. 11) will reside in the T-slots 404 (FIG. 8) of the shell member. It should be noted that when in this position, the internal electrical components are entirely sealed from exterior moisture or contaminants. This seal is provided by the discrete seals 624 residing in compression in the respective bores 432, 434 and 436 of the shell housing and in bores 526, 528 and 530 in the socket housing. It is also sealed by the fact that an O-ring 612 is included in an O-ring groove 610 (FIG. 12) such that when the socket housing is inserted into the shell member the O-ring is in compression against the inner surface 402 of the shell housing.

Figure 20:
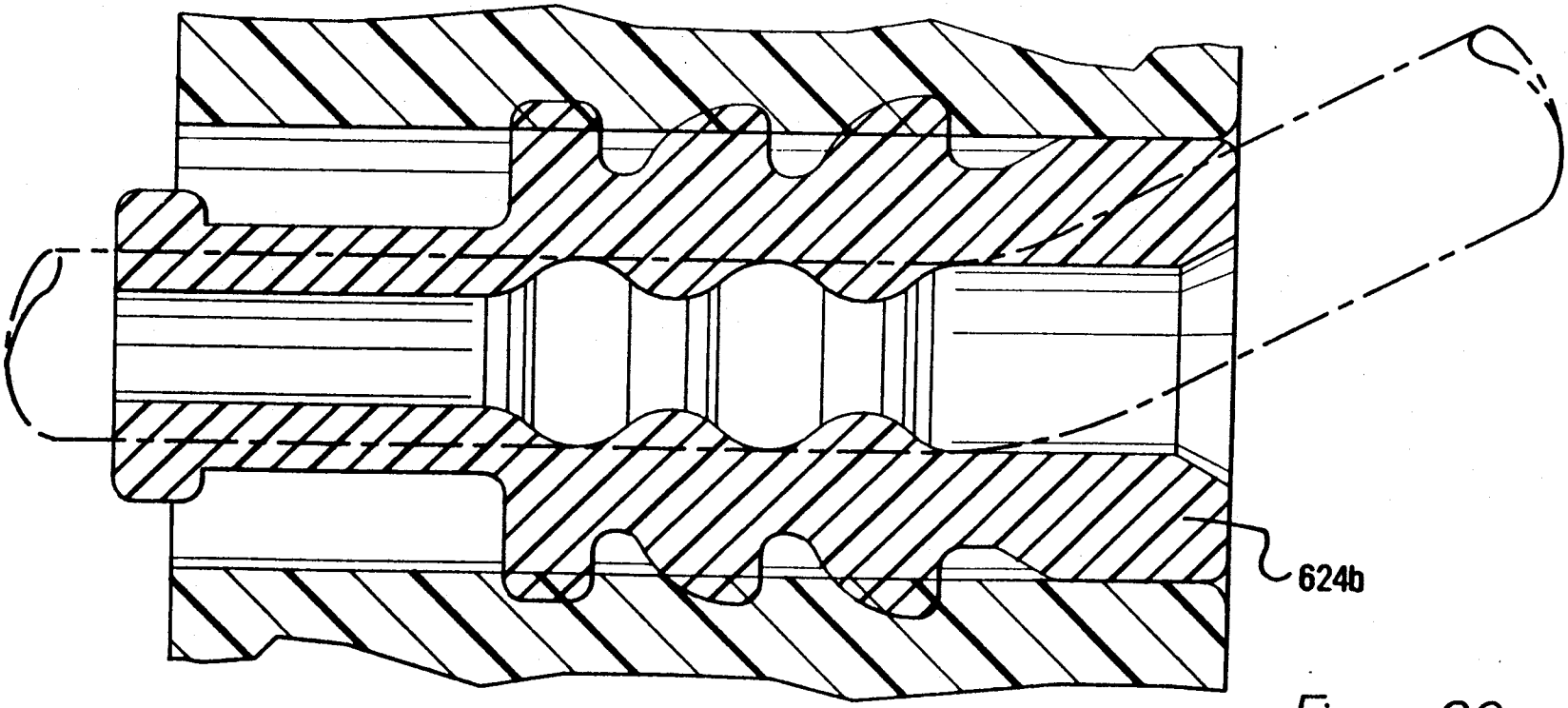
FIG. 20 is a diagrammatical cross sectional view through one of the terminal receiving passageways showing the deflection of the grommet collar upon the pulling of the wire.

The grommet 624 is also an improved design. The grommet includes a forward rib 624*d*, a reduced diameter portion 624*c*, sealing ribs 624*a*, and an extended collar portion 624*b*. When the grommet 624 is placed within any of the bores 432, 434, 436; 526, 528, 530; the extended collar portion 624*b* of the grommet is adjacent to the rear face 429 or 525, respectively. As shown in FIG. 20, which is only a diagrammatical view, if the wire is pulled at an angle relative to the axial length, the collar only is compressed which prevents the ingress of water into the cavity. In other words, the collar is compressed which prevents the ribs from pulling away from the cavity bore. If the ribs are pulled away from the cavity bore, water will enter into the cavity and be pumped into the interior of the cavity.

We claim:

1. A sealed electrical connector comprising:

an insulating outer housing having at least one terminal receiving opening therethrough, the opening comprising an enlarged bore section which extends inwardly from an outer rear wall, the bore extending forwardly toward a mating end of the shell, the bore extending forwardly and spiring at an end face, the housing having an alignment member extending forwardly from the end face and having a surface which is axially coincident with the inner surface of the bore, the alignment member having at an inner end thereof a rearwardly facing latching surface;

a terminal receiving inner housing profiled for receipt with the outer shell, the housing having a rear face which abuts with the end face of the outer shell, the inner housing having at least one terminal receiving passageway which , when in place in the outer housing, is aligned with the opening in the outer housing, the passageway extending from a rear face of the inner housing to a font mating face of the inner housing, the passageway having a terminal latching surface therein, the portion of the passageway which is adjacent of the rear face of the inner housing including an open axial slot which is profiled to receive the alignment member of the outer shell therein, the slot having at an inner end thereof a lip which overlaps the rearwardly facing latch surface to fixedly latch the inner housing to the outer housing;

an electrical terminal positioned in said terminal receiving passageway and in position against said terminal latching surface; and a sealing grommet positioned in said enlarged bore, said grommet having an aperture therethrough, whereby said sealing grommet can be slidable received over the wire, and the sire and an electrical terminal can be positioned in said inner housing, while said grommet is positioned in said enlarged bore to seal the terminal receiving passageway.

2. The electrical connector of claim 1, wherein said grommet includes a forward gripping rib and said terminal includes gripping arms for wrapping around said gripping rib, for maintaining said grommet to said terminal.

3. The connector of claim 1, wherein said grommet includes an elongate collar and a plurality of sealing ribs, the collar being positioned adjacent to the rear face of the connector housing means and positioned within said terminal receiving passageway, said elongate collar being of a sufficient length that if the wire is pulled t an angle relative of the axial length, the collar, no the ribs will be compressed, preventing the ingress of water beyond an outermost rib.

4. The electrical connector of claim 3, wherein aid terminal is latchably attached within said through passageway of said inner housing, and said collar and ribs of said grommet are seemingly positioned within said through bore of said outer housing.

* * * * *

UNITED STATES PATENT AND TRADEMARK OFFICE

CERTIFICATE OF CORRECTION

PATENT NO. : 5,147,222

DATED : September 15, 1992

INVENTOR(S) : Gheorghe Hotea et al.

It is certified that error appears in the above-identified patent and that said Letters Patent is hereby corrected as shown below:

Col. 6, claim 1, line 24, change "sire" to --wire--.

Signed and Sealed this

Nineteenth Day of October, 1993

*Attest:*

Bruce Lehman

BRUCE LEHMAN

*Attesting Officer*

*Commissioner of Patents and Trademarks*